United States Patent [19]

Schipper et al.

[11] 4,332,129

[45] Jun. 1, 1982

[54] MULTI-SPINDLE DOUBLE TWIST TWISTING MACHINE

[75] Inventors: Heinz Schipper; Wolfgang Hartig; Klaus Weber, all of Remscheid-Lennep; Josef Blumberg, Hückeswagen; Bernd Wessolowski, Remscheid, all of Fed. Rep. of Germany

[73] Assignee: Barmag Barmer Maschinenfabrik AG, Remscheid, Fed. Rep. of Germany

[21] Appl. No.: 161,392

[22] Filed: Jun. 20, 1980

[30] Foreign Application Priority Data

| | | | |
|---|---|---|---|
| Jun. 23, 1979 | [DE] | Fed. Rep. of Germany | 2925458 |
| Jun. 23, 1979 | [DE] | Fed. Rep. of Germany | 2925459 |
| Jun. 23, 1979 | [DE] | Fed. Rep. of Germany | 2925460 |
| Aug. 4, 1979 | [DE] | Fed. Rep. of Germany | 2931716 |

[51] Int. Cl.[3] ..... D01H 1/20; D01H 1/241

[52] U.S. Cl. ..... 57/105; 57/1 R

[58] Field of Search ..... 57/1 R, 58.49, 92, 104, 57/105, 130, 136, 352

[56] References Cited

U.S. PATENT DOCUMENTS

| | | | |
|---|---|---|---|
| 3,641,757 | 2/1972 | Rehn | 57/105 X |
| 3,645,084 | 2/1972 | Nimtz | 57/104 X |
| 3,782,087 | 1/1974 | Franzen et al. | 57/1 R |
| 4,036,000 | 7/1977 | Grieve | 57/1 R |
| 4,090,348 | 5/1978 | DeVittorio | 57/105 |

*Primary Examiner*—Donald Watkins

*Attorney, Agent, or Firm*—Richards, Shefte & Pinckney

[57] ABSTRACT

A multi-spindle double twist twisting machine having a belt drive assembly, a spindle frame formed to enclose the belt drive assembly, and traversing rod reciprocating means. The machine may be a horizontal spindle machine with two rows of spindles on each side. A beam mounted independently of the spindle frame extends along each side between rows and supports a drive belt for tangential driving contact with spindle whorls. The belts are commonly driven and reversing rolls are associated with one belt so that it travels opposite the other belt, and compensating rolls are associated with the other belt so that the belts may be of the same length. The spindle frame has two spaced support plates laterally outward of the belt drive assemblies and two cover plates secured to and extending between flanges on the support plates to form an enclosure for the belt drive assembly. The traversing rod reciprocating means uses a pulley and drive belt take-off from the drive shaft of one traversing rod reciprocating cam to drive a second cam so that only one drive motor, replaceable gear assembly and modulating gear assembly are required.

23 Claims, 12 Drawing Figures

MULTI-SPINDLE DOUBLE TWIST TWISTING MACHINE

BACKGROUND OF THE INVENTION

The present invention relates to multi-spindle double twist twisting machines and more particularly to a belt drive assembly therefore and related spindle frame and traversing rod reciprocating means.

Multi-spindle double twist twisting machines have been well-known and in commercial use for many years. There are two basic types of such machines, the one in longest prior use being the type with the axes of the spindle assemblies being arranged in vertical disposition, and the more recent type being that in which the spindle assemblies are arranged with their axes in horizontal disposition. An example of the latter is disclosed in Barmag (Rehn) U.S. Pat. No. 3,641,757, issued Feb. 15, 1972.

In the conventional vertical spindle machines there are usually two parallel rows of spindle assemblies extending from a common level, whereas in the horizontal spindle machines there are usually two rows of spindle assemblies on each side of the machine, which is of particular advantage in that a greater number of spindles in the same floor space is possible in comparison with a vertical spindle machine and the spindle assemblies are more assessable than in the vertical spindle machine. Also, the noise factor is reduced in a horizontal spindle machine. Thus, the horizontal spindle machine has efficiency and operational advantages over the vertical spindle machine, but the vertical machine may be made in a simple construction with less investment for smaller capacities and is less complicated in operation. As a result, both the horizontal spindle and the vertical spindle machines have commercial significance and are in common use.

In both the horizontal spindle and vertical spindle machines, belt drive assemblies are utilized to drive the spindle assemblies by belt engagement of whorls on the spindle assemblies and, because of this relationship, spindle frames have been conventionally designed and constructed for at least partial mounting support of the belt drive assemblies. This has involved specific interrelated spindle frame and belt drive assemblies that are of limited versatility in adaptation of components for use in different machines, e.g. horizontal and vertical spindle machines. It has resulted in rather complicated constructions from design and maintenance standpoints, and in undesirable noise transmission from the belt drive assemblies to the spindle frames and, therefore, to the exterior. In contrast, the present invention provides a belt drive assembly of simple and effective construction and operation that may be mounted on a machine independent of the spindle frames so that a common belt drive assembly may be used on machines having different types of spindle frames. This also results in considerable manufacturing and inventory savings as components of a single form of belt drive assembly can be manufactured and stored for supply in assembling or servicing different types of machines. Further, the independent arrangement of the belt drive assembly allows it to be made simply and compactly, and also it can be structurally isolated from the spindle frame to minimize noise creating transmission of vibrations from the belt drive assemblies to the spindle frames and then to the exterior.

The emission of noise is an increasing problem with twisting machines, particularly as increased speed capabilities are being developed. In this regard, in addition to the noise reduction advantage of independent mounting of the belt drive assemblies, the present invention in one feature provides for a simple and effective enclosure arrangement utilizing the spindle frames in a plate construction in combination with other cover plates to surround the belt drive assemblies. This not only reduces noise transmission, but also protects the enclosed components and provides a conduit for air circulation and control lines.

In prior horizontal spindle machines, such as the aforementioned Barmag (Rehn) U.S. Pat. No. 3,641,757, and in Sabaton U.S. Pat. No. 2,638,732 it is known to arrange two rows of spindles on each side of a machine with the spindle axes horizontal and with the spindle whorls projecting into the machine. In the first patent, a relatively complicated belt drive assembly is utilized to drive a limited number of spindles on opposite sides of the machine from a central shaft in an arrangement designed to provide adequate belt contact for continuous uniform rotation. In the second patent, a single belt runs the length of the machine for tangential contact of the whorls of the spindle assemblies on both sides of the machine, which results in a limited number of spindles as the spindles on opposite sides must be staggered to avoid contact because the spindles on both sides have their whorls along the common line of the belt. In contrast, the present invention provides a belt drive assembly that can be adapted to a horizontal spindle machine using a single belt on each side of the machine running the full length of a machine section in a simple and compact construction without any limiting interrelation between the belt drive of the spindles on opposite sides of the machine.

Another drive on multi-spindle double twist twisting machines to which the present invention is directed is that of reciprocating the traversing rods that carry the take-up yarn guides for directing the yarn to the take-up rolls after they leave the spindle assemblies and have been twisted by the machine. In the horizontal spindle machine there are two levels of take-up systems on each side of the machine so that the yarn from both rows of spindle assemblies can be taken up without interference in as short a space as possible. This may also be done in a vertical spindle machine where it is not as important, but where reciprocating drive is none the less necessary. In both types of prior machines it is conventional to utilize a separate drive motor or at least separate gearing to drive the take-up systems on opposite sides of the machine. In contrast, the present invention includes a simple and economical means for reciprocating the traversing rods utilizing a common motor and gearing.

SUMMARY OF THE INVENTION

Briefly described, the belt drive assembly of the present invention is incorporated in a multi-spindle double twist twisting machine of the type in which spindle assemblies are mounted with whorls aligned in at least one longitudinal row and with the belt drive assembly serving to drive the whorls with a drive belt extending longitudinally adjacent the whorl row and supported by belt supporting and guiding elements that guide the belt in contact with the whorls. Means for supporting the belt guiding elements are mounted in the machine independent of the mounting of the spindle assemblies, and means are provided for driving the belt as supported and guided by the aforesaid elements. This arrangement permits the belt drive assembly to be independent of the spindle assemblies for versatility in usage without restriction to particular spindle frame constructions.

Preferably the support means is in the form of a beam extending longitudinally through a section of the machine adjacent the row of whorls and supporting the belt guiding elements for projection of the elements therefrom adjacent the whorls. This beam arrangement is particularly advantageous where there are two longitudinally extending rows of whorls and the beam extends longitudinally between the rows with the belt guiding elements projecting from the beam adjacent both rows of the whorls for supporting and guiding the belt to position one reach of the belt in contact with the whorls in one row and another reach of the belt in contact with the whorls in the other row. Preferably the elements and reaches of the drive belt are disposed between the whorl rows, which facilitates the independent mounting and provides a simple and compact assembly. This also facilitates driving of the whorls by tangential contact of the belt with the whorls so that one or more whorls is permitted to be disengaged without slackening of the belt sufficient to disrupt drive of the other whorls.

This drive belt assembly is adaptable for use in a machine having a longitudinally extending plurality of sections with frame stands at each end of each section, in which case there is a beam extending longitudinally through each machine section with its ends mounted to the frame stands independent of the mounting of associated spindle assemblies.

Thus, the present invention provides a versatile, simple and compact construction that is operationally advantageous. Further, the independent mounting of the drive belt assembly results in reduced transmission of noise generated by vibrations in the drive belt assembly to the spindle assembly.

Noise reduction is also obtained by the spindle frame of the present invention which comprises at least one longitudinally extending support plate for mounting spindles thereon with whorl portions projecting in freestanding arrangement from one side of the plate. The support plate has side flanges projecting from the longitudinal edges thereof in the direction of projection of the whorl portions to provide sides to the spindle frame for attachment of enclosure plates thereto. By attaching longitudinally extending enclosure plates to the flanges an enclosure can be formed enclosing the extent of the belt drive assembly adjacent the whorl row. Preferably this enclosure has a liner of noise dampening material on the interior thereof. In the preferred embodiment there are a pair of spaced and opposed support plates vertically disposed for supporting spindle assemblies with their axes horizontal and their whorl portions projecting in horizontal rows in freestanding arrangement in the space between support plates, and longitudinally extending enclosure plates extend between the support plates and are secured to the flanges thereof to form with the support plates an enclosure enclosing the extent of the belt drive assembly adjacent the whorl rows. Preferably there are two vertically spaced horizontally extending whorl rows supported by each support plate and there are two longitudinally extending beams, one disposed between the whorl rows of one support plate and the other disposed between the whorl rows of the other support plate. In this arrangement the belt supporting and guiding elements are supported on the beams with a pair of drive belts being supported and guided, one by the elements on one of the beams and the other by the elements on the other of the beams, and with the belts being disposed between whorl rows on the support plates.

This enclosure feature of the present invention not only provides for noise reduction and protection of the belt drive assembly therein, but also serves as a conduit for air circulation and control lines.

When adapted to a horizontal spindle machine the belt drive assembly may include two drive belts, one on each side of the machine extending adjacent the whorl rows on that side. In such case there would be two vertically spaced longitudinally extending horizontal rows of spindle assemblies on each side of the machine with the spindle assemblies having their axes horizontal and whorls projecting laterally inward in two vertically spaced rows of whorls and the drive belts extending adjacent both whorl rows. The drive belts are supported and guided in tangential driving contact with the whorls in both rows on each side of the machine, and drive means are provided for preferably driving the belts in opposite directions so that the winding operation will be the same on both sides.

Preferably, a common drive motor is utilized for driving both belts through a common drive shaft that has a drive roll mounted at each drive belt and around which the belts are trained. To provide for the belts operating in opposite directions, a pair of reversing rolls are disposed beyond one of the drive rolls with one of the reversing rolls extending above the level of the drive roll and the other extending below the level of the drive roll for training of the drive belt around one of the reversing rolls, back reversely around the drive roll and then around the other reversing roll, thereby driving the drive belt in a direction opposite to the direction the other drive belt is driven. This results in a longer belt path than the path followed by the other belt that travels directly around its drive roll, and, in order to be able to stock and use only one length drive belt, the present invention contemplates the use of a compensating roll mounted for training of the other drive belt therearound. This compensating roll is offset with respect to the path of the belt to increase the travel length substantially equivalent to the increase in the travel length resulting from the reversing rolls, and preferably the compensating roll is adjacent the end of the belt reaches opposite the location of the drive rolls to avoid interference or construction complications.

To maintain proper tension of the belts for tangential driving contact of the whorls, the present invention includes belt tensioning means disposed beyond and offset from the other end of the reaches of the belts for tensioning and deflection of the belts at an inclination from the horizontal extent of the belt reaches. Preferably this belt tensioning means includes a slide member movable at the inclination and a tensioning roll mounted on the slide member for movement therewith and around which the drive belt is trained for tensioning thereof. In the preferred embodiment this belt tensioning means includes a threaded rod attached to the machine and threadably engaging the slide member for adjustable movement of the slide member to adjust the tension of the drive belt.

The present invention also includes means for reciprocating the traversing rods of machines that have yarn take-up assemblies with reciprocating yarn guides mounted on a plurality of such traversing rods. This feature includes a drive motor, a conventional replaceable gear assembly driven by the drive motor and having replaceable gear components to change the driving relation, a conventional traverse modulating gear assembly driven by the replaceable gear assembly to impose a modulated traversing pattern to the take-up winding of the yarn, and rotating cam means driven by the traverse modulating gear assembly. At least one cam follower is in following engagement with the cam means and is connected to at least one of the traversing rods for reciprocation thereof. The present invention adds to this conventional construction a drive take-off means connected to the rotating cam means and driven thereby with another rotating cam means being driven by the drive take-off means so that another cam follower in following engagement with the other rotating cam means can reciprocate other traversing rods without an additional drive motor or gear assemblies.

Preferably, the means for reciprocating the traversing rods includes a cam drive shaft driven by the modulating gear assembly and driving the drive take-off means, and the other rotating cam means includes another cam drive shaft driven by the drive take-off means. In the preferred embodiment the drive take-off means includes aligned pulleys on the cam drive shafts and a drive belt trained around the pulleys to transmit drive from one cam drive shaft to the other, and there are two cam followers in following engagement with each cam means for reciprocation of two traversing rods by each cam means, thus adapting the assembly for use with machines having two rows of spindle assemblies on each side of the machine.

DETAILED DESCRIPTION OF THE PREFERRED EMBODIMENTS OF THE PRESENT INVENTION

Figure 1:
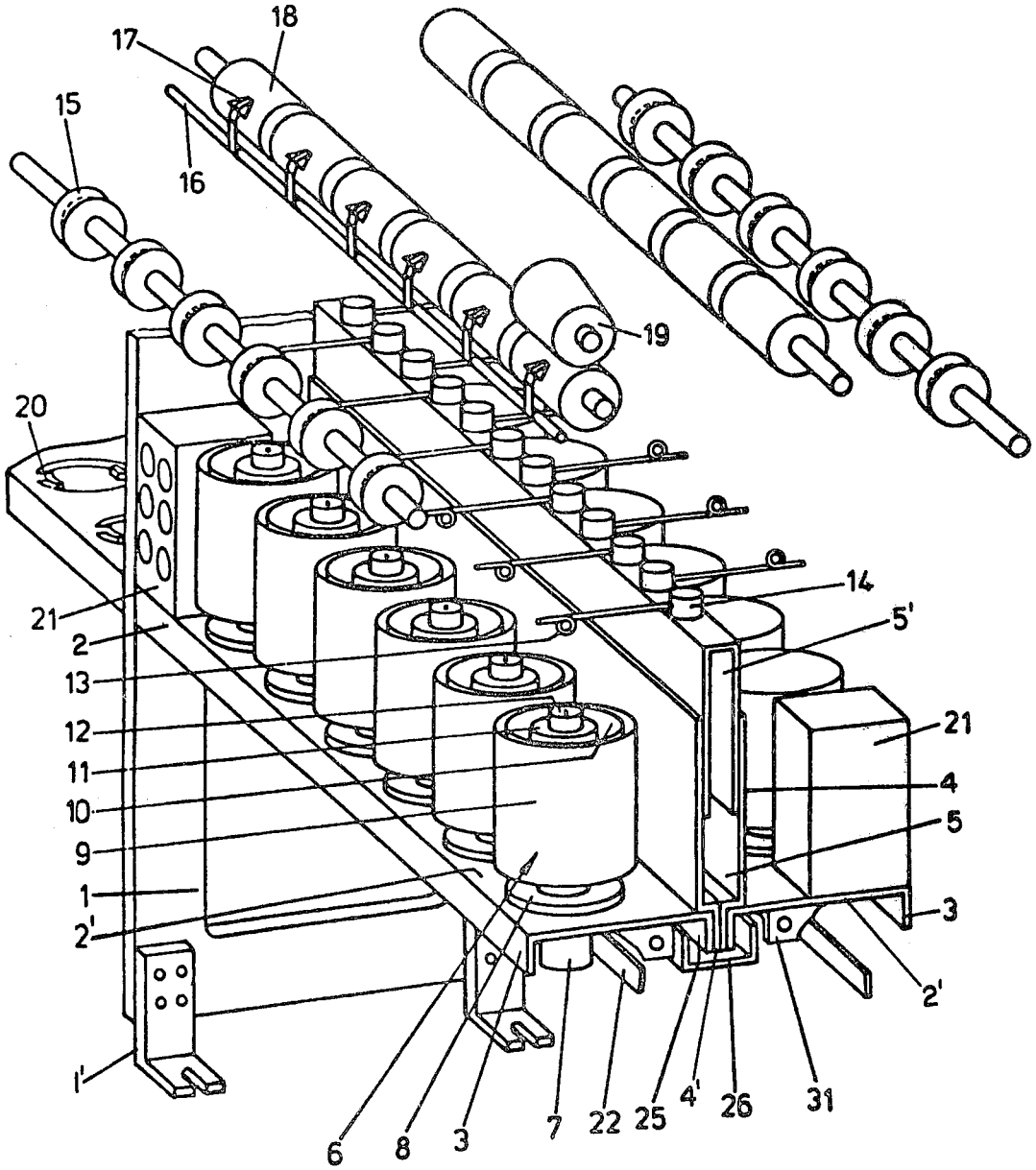
FIG. 1 is a partially broken-away perspective view of a multi-spindle double twist twisting machine of the type having vertically arranged spindle assemblies and in which the preferred embodiment of the present invention is incorporated.

Both vertical spindle and horizontal spindle type multi-spindle double twist twisting machines are illustrated and described herein, and insofar as the components are identical in the two types of machines, the same reference numerals are used herein for the components of both machines.

Figure 4:
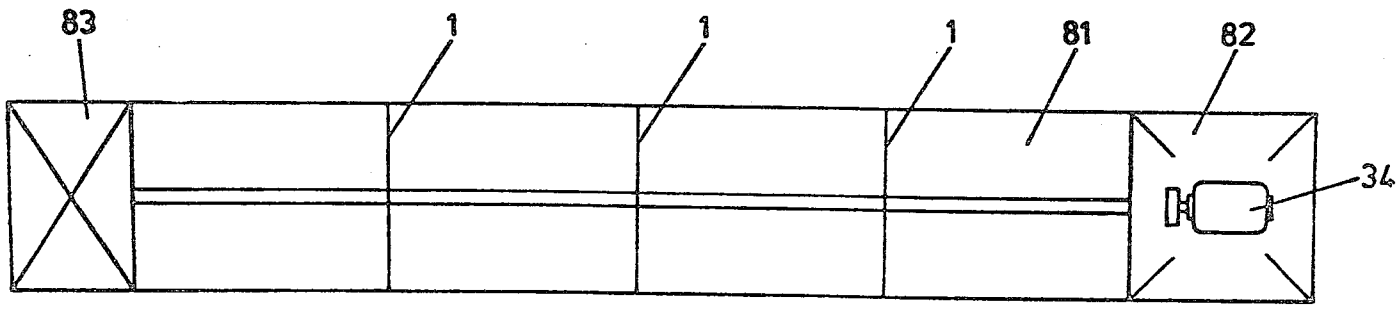
FIG. 4 is a schematic layout of the machine of FIG. 1 or the machine of FIG. 2.

Referring first to the vertical spindle machine of FIG. 1, it is seen that there is provided a vertical frame stand 1 that supports each end of each section of the machine and which is mounted to the floor by angle brackets 1'. As illustrated in FIG. 4, there are a plurality of machine sections 81, each being mounted between and on vertical frame stands 1. At one end of the machine is a drive housing 82 that contains the main drive components and at the other end of the machine is an end housing 83 containing other drive components of the machine.

In each machine section 81 a spindle frame 2 extends horizontally between the frame stands 1 and is secured thereto for support of spindle assemblies 6 in which delivery packages 11 are disposed for withdrawing of yarn by the machine in a double twist twisting operation. For this purpose the spindle assemblies 6 include a protection pot 10 in which the delivery package 11 is mounted and which pot is contained in a balloon limiter 9 of cylindrical construction for controlling the extent of ballooning of the yarn being discharged from the twisting operation in the spindle assembly as it passes upwardly through a ballooning yarn guide 13 around a take-off roll 15 through a traverse thread guide 17 that is carried by a traversing rod 16, and from which guide 13 the yarn passes onto a take-up package 19 that is driven by a take-up drive roll 18. There is such an arrangement of components for each spindle assembly 6 and the spindle assemblies are mounted in two parallel rows extending longitudinally of the machine with two rows of take-off rolls 15, and take-up drive rolls 18. In this vertical spindle machine the take-off rolls 15, traversing rods 16 and take-up drive rolls 18 may be driven by conventional drive mechanisms well known in the art and which do not require disclosure herein. Also, the specific details of the double twist twisting accomplished by the spindle assemblies is conventional and well-known such that a detailed disclosure is not necessary herein.

The spindle frame 2 is formed with two horizontal support plates 2' extending longitudinally between adjacent frame stands 1 and secured together in parallel relation. Each support plate is formed with longitudinal ends to which mounting brackets 31 are secured for mounting of the plate to the frame stands 1 at the ends of the machine section 81 without intermediate support, thereby serving as a self-supporting subframe that may be alternatively mountable in a horizontal spindle machine as well as in the presently described vertical spindle machine.

Each support plate 2' is formed for the mounting of a longitudinal row of spindle assemblies 6. For this purpose, each support plate 2' is formed with openings 20 arranged in a row for attaching therein of spindle assembly mounting means 8 in the form of bearing assemblies that attach in the openings in a bayonet-type lock.

Such a spindle assembly mounting means 8 is disclosed in Rehn U.S. Pat. No. 3,716,980. The spindle assemblies 6 are mounted in the spindle assembly mounting means 8 with the whorl portion 7 of the spindle assembly 6 projecting in freestanding arrangement from one side of the support plate 2', downwardly in FIG. 1, and a yarn supporting portion of the spindle assembly projecting in freestanding arrangement from the other side of the plate 2', upwardly in FIG. 1.

Each support plate 2' is provided with side flanges 3 projecting from the longitudinal edges thereof in the direction of projection of the spindle assembly whorl portions 7 to provide sides to the spindle frame for rigidifying the frame and for attachment of enclosure plates as mentioned herein below. These side flanges 3 extend along not only the outer edges of the support plates 2' but also along the adjacent edges centrally of the spindle frame 2 for connection of the corresponding adjacent flanges for attachment of the support plates 2' to form an integral support plate. By having this support plate construction, a single form of support plate can be used on each side of the spindle frame so that only one type of support plate need be manufactured and inventoried.

Figure 3:
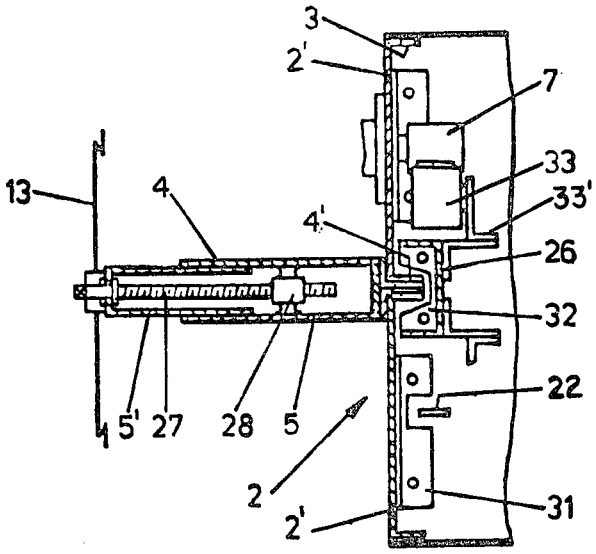
FIG. 3 is a vertical sectional view of a spindle frame included in both the machine of FIG. 1 and the machine of FIG. 2.

As seen in FIGS. 1 and 3, the support plate flanges 3 along the center of the spindle frame are secured together with a centrally located separator wall 4 projecting perpendicularly from the support plates 2' along the longitudinal center line of the spindle frame 2 on the side from which the spindle assembly yarn supporting portions project to provide separation of the spindle assemblies 6 in one row from those in the other and thereby prevent entanglement or other interference by a broken yarn from one spindle assembly with the yarn of a spindle assembly in the other row. The separator wall 4 is provided with a downwardly projecting flange 4' that extends longitudinally and centrally between the adjacent flanges 3 of the support plates 2' and through which the support plate flanges 3 are secured together by bolts, rivets, welding or other known connecting means. This integral incorporation of the separator wall in the support plate arrangement provides a spindle frame complete with separator wall that is capable of utilization in either a vertical or a horizontal spindle machine.

For versatility of the spindle frame 2, the separator wall 4 is made to be extendable perpendicularly of the support plates 2' to allow adjustment of the projecting extent of the separator wall and provide necessary separation with different size yarn packages and under different operating conditions while permitting adjustment to the least projecting extent necessary, thereby minimizing obstruction to access to the spindle frames and yarn packages. In the illustrated embodiment, the separator wall extension is provided by forming the separator wall 4 with an inner base portion 5 from which the flange 4 projects for attachment to the support plates 2' and formed in an upwardly opening U-shape for telescoping receipt of an outer adjustable portion 5' of inwardly opening U-shape construction. The outer portion 5' is adjustable within the inner portion 5 by means of stationary threaded sleeves 28 secured in the inner base portion 5 and threadably receiving a rotatable threaded rod 27 mounted in the outer portion 5' so that rotation of the rod 27 will advance or retract the rod in the sleeve 28 and thereby advance or retract the outer portion 5' within the inner portion 5. With this adjustable arrangement, the ballooning yarn guides 13, which are mounted on supports 14 on the outer ends of the outer portions 5' of the separator wall 5 are correspondingly adjustable for proper positioning of the yarn guides 13 with respect to the spindle assemblies 6 for optimum operating relation, and as all of the guides 13 for both spindle assembly rows are mounted on the common separator wall 4, single adjustment of the separator wall 4 will result in simultaneous and corresponding adjustment of all of the guides 13 in the machine section 81.

Figure 5:
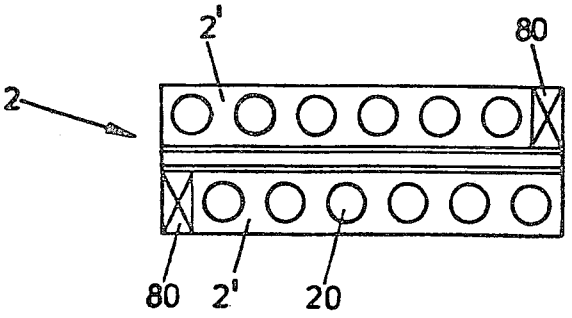
FIG. 5 is a diagrammatic illustration of an arrangement of support plates for a spindle frame of FIG. 3.
Figure 6:
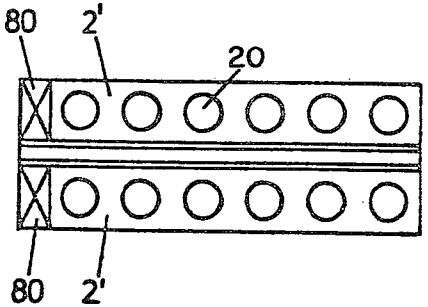
FIG. 6 is a view similar to FIG. 5 showing the support plates in an alternate arrangement.

The spindle assemblies 6 in one row are arranged as illustrated in FIG. 1 in staggered relation with respect to the spindle assemblies 6 in the adjacent row, which facilitates the arrangement of the mounting of the ballooning yarn guides 13 for both rows in longitudinal alternate alignment on the common separator wall 4. The staggered relation is accomplished by having the spindle assembly mounting means 8 in both rows equally spaced and with the spindle assembly mounting means in one row staggered with respect to the spindle assembly mounting means in the other row at a spacing of approximately one-half the spacing between the centers of spindle assemblies. This will provide a spacing between one end of each row and the end of the machine section 81 a distance greater by approximately one-half of the space between the centers of spindle assemblies in the row than the spacing between the other end of the row from the other end of the section. This is illustrated in FIG. 5. This results in a free space 80 at one end of the machine, which space can be conveniently utilized to support a receiver 21 for temporarily storing spindle assembly heads 12 when replacing yarn packages or when servicing the spindle assemblies. Preferably, the width of each receiver is equivalent to approximately one-half the spacing between the centers of spindle assemblies 8 in the row and the receivers on opposite sides of the spindle frame are at the opposite ends of the section. As the support plates 2' are identical, they can be connected together in the aforementioned staggered relation or one of the support plates 2' can be reversed so that the spindle assemblies 6 are aligned, which would result in the receivers 21 being at the same end of the machine section 81. This is illustrated in FIG. 6.

The above-described spindle frame 2 and its advantageous sub-frame construction as well as its use of identical support plates 2' is uniquely applicable to a horizontal spindle machine as to the described vertical spindle machine, which enhances the versatility of the spindle frame 2 and increases its commercial utilization. This is particularly so for a manufacturer of both horizontal spindle and vertical spindle machines as production and inventorying of only one type of spindle frame 2 is necessary to satisfy the needs for both types of machines. Further, this spindle frame 2 is designed for mounting in a machine independent of the spindle drive system so that variations in drive systems will not reduce the versatile utilization of this spindle frame.

Figure 2:
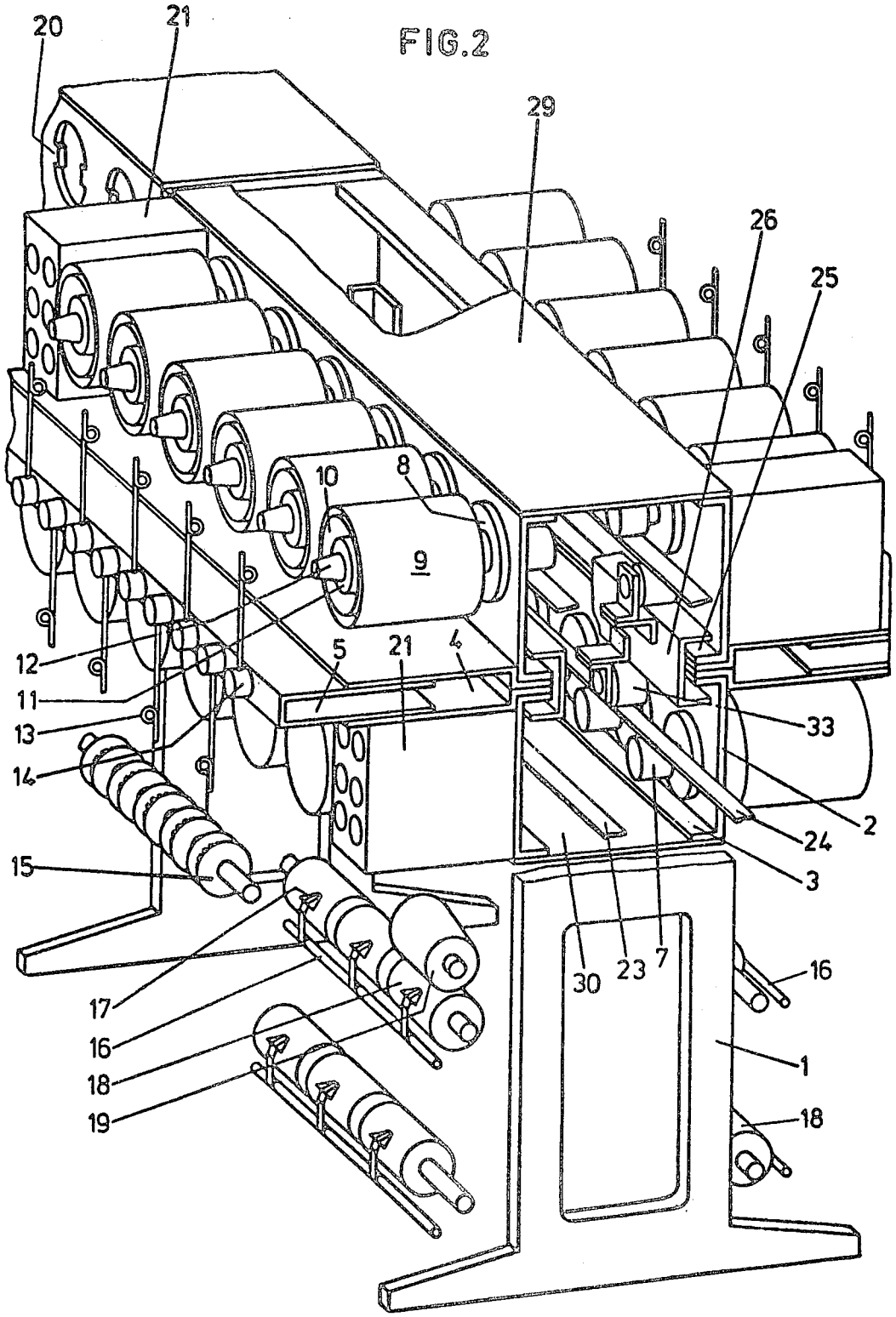
FIG. 2 is a partially broken-away perspective view of a multi-spindle double twist twisting machine of the type having horizontally arranged spindle assemblies and in which the preferred embodiment of the present invention is incorporated.

The application of this spindle frame 2 to a horizontal spindle machine is illustrated in FIG. 2 in which two spindle frames 2 identical to the spindle frame of FIG. 1 are arranged with the spindle assemblies 6 projecting horizontally and with one spindle frame 2 on each side of the machine spaced apart to provide a space for accommodating the spindle drive mechanism. In this horizontal spindle machine the staggered relation of the spindle assemblies 6 is of particular significance as the take-off rolls 15 and take-up drive rolls 18 for both rows of spindle assemblies 6 are below the spindle frame 2, requiring the yarn from the upper row of spindle assemblies 6 to pass across the lower row of spindle assemblies 6. With this staggered relation, the take-off from the spindle assemblies in the upper row will pass between the spindle assemblies in the lower row without interference and will also avoid interference with the take-off rolls 15 and take-up drive rolls 18 for the other spindle assembly row.

The aforementioned support plate flanges 3 serve a further function in the horizontal spindle machine as they provide supports for attachment of enclosure plates 29 and 30 that extend across the machine section 81 between adjacent spindle frames 2 at the top and bottom thereof, thereby forming with the spindle frames 2 an enclosure to reduce noise transmission created by the spindle drive mechanism contained within the enclosure, which noise dampening is further enhanced by applying a liner of any conventional noise dampening material on the interior of the enclosure. The enclosure also conveniently can serve as a conduit for air circulation and for control lines.

As will be described hereinafter, the spindle drive mechanisms for the horizontal spindle machine is different than the spindle drive mechanism for the vertical spindle machine, but the present spindle frame construction is importantly independent of the spindle drive mechanism such that the same spindle frames 2 can be used in either type of machine without limitation to the drive mechanism. Also, it should be noted that in the horizontal spindle machine the take-off rolls 15, the traversing rods 16 and the take-up drive rolls 18 may be conventionally driven as in the case of the vertical spindle machine described above, but preferably the traversing rods 16 are reciprocated by the particular mechanism described hereinbelow.

The spindle frame 2 of the present invention has further versatility in that a single support plate 2' could be used without change in a machine in which only one row of spindle assemblies is to be arranged, and support plates 2' can be combined without change without a separator wall. Also, the separator wall 4 can be modified where balloon limiters 9 are used as in such case it is not necessary that the separator wall be solid in the location of the balloon limiter and the inner base portion 5 of the separator wall 4 could be eliminated and mountings provided for the stationary threaded sleeves 28, thereby providing for adjustability of the adjustable portion 5' beyond the extent of the balloon limiter 9.

The means for driving the spindle assemblies is the same for the vertical spindle machine and the horizontal spindle machine in terms of the components directly associated with each spindle frame 2, but differ in the arrangements beyond the machine sections 81 for driving the belts of the drive means. In the vertical spindle machine in which only one spindle frame 2 is utilized in each machine section 81, a single drive belt 22 runs the length of the machine with a reach of the belt driving the whorl portions 7 of one row of spindle assemblies 6 and the other reach of the belt 22 driving the whorl portions 7 of the spindle assemblies 6 of the other row. In the horizontal spindle machine there is a similar drive belt 23 similarly associated with one spindle frame 2 and another drive belt 24 similarly associated with the other spindle frame. These drive belts 22, 23 and 24 extend longitudinally in tangential contact with the whorl portions 7 of the spindle assemblies 6 and are maintained in driving engagement therewith by belt supporting and guiding elements or rolls 33 located on the opposite side of the belt from the whorl portions 7 and intermediate each pair of whorl portions 7. These guiding rolls 33 are mounted on brackets 33' that project from a beam 26 that extends longitudinally through the machine section 81 adjacent the whorl portions 7 along the longitudinal center line of the spindle frame 2 between the rows of spindle assemblies 6. These beams are U-shaped and overlap the center flanges 3 of the support plates 2', but importantly are not in contact with or connected to the spindle frame 2. Rather, the beams 26 are mounted by mounting plates 32 to the frame stands 1 at the longitudinal ends of the beams 26. This independent mounting of the beams 26 permits use of a spindle frame construction that is not dependent on the belt drive means and similarly allows the use of a drive belt means that is not dependent on the spindle frame. It also allows inventorying of sub-assemblies of spindle frames and separates noise generation by the belt drive means from the spindle frame and isolates noise within the aforementioned enclosure.

Figure 7:
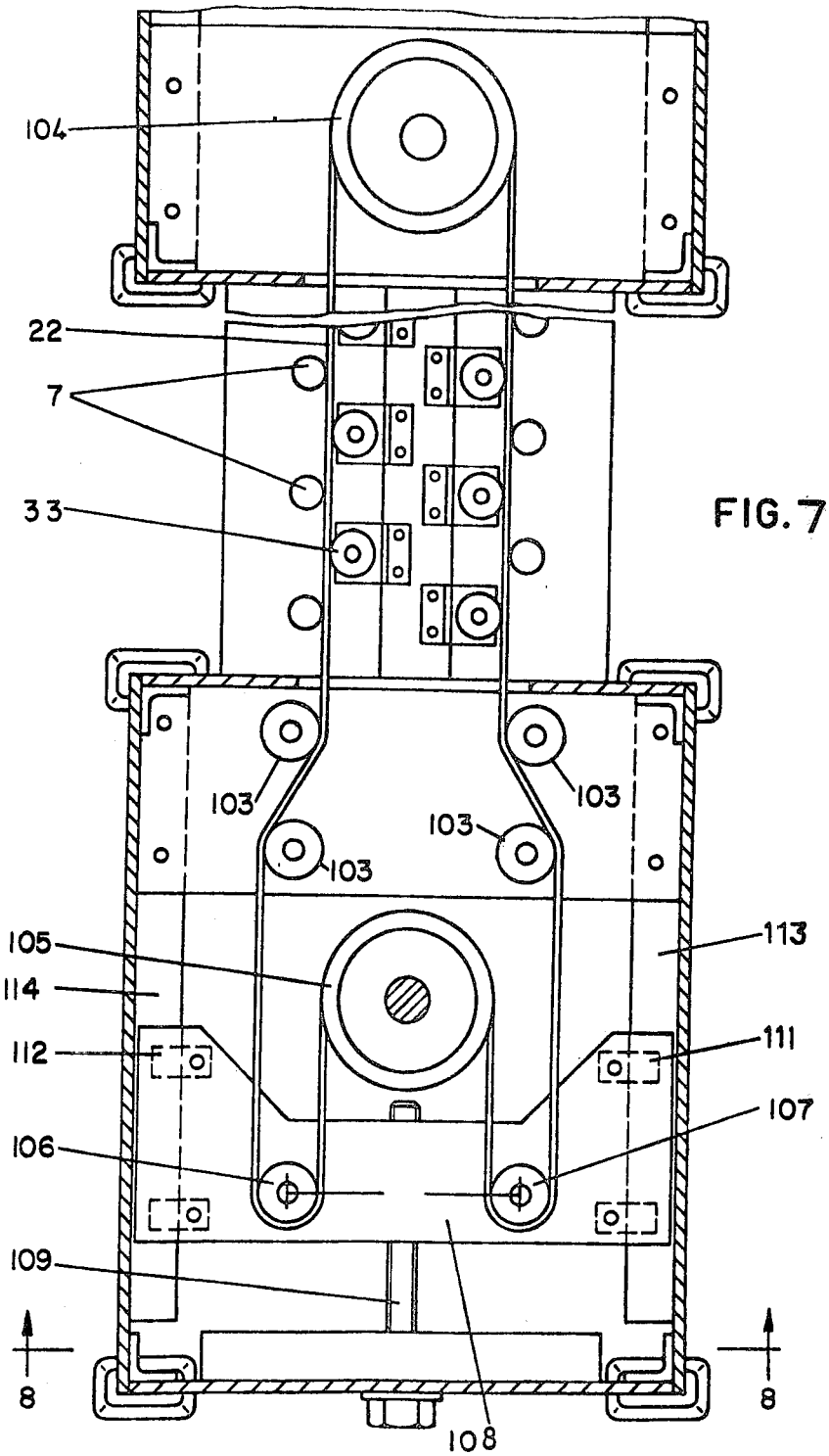
FIG. 7 is a horizontal sectional view illustrating the belt drive assembly of the vertical spindle machine of FIG. 1.
Figure 8:
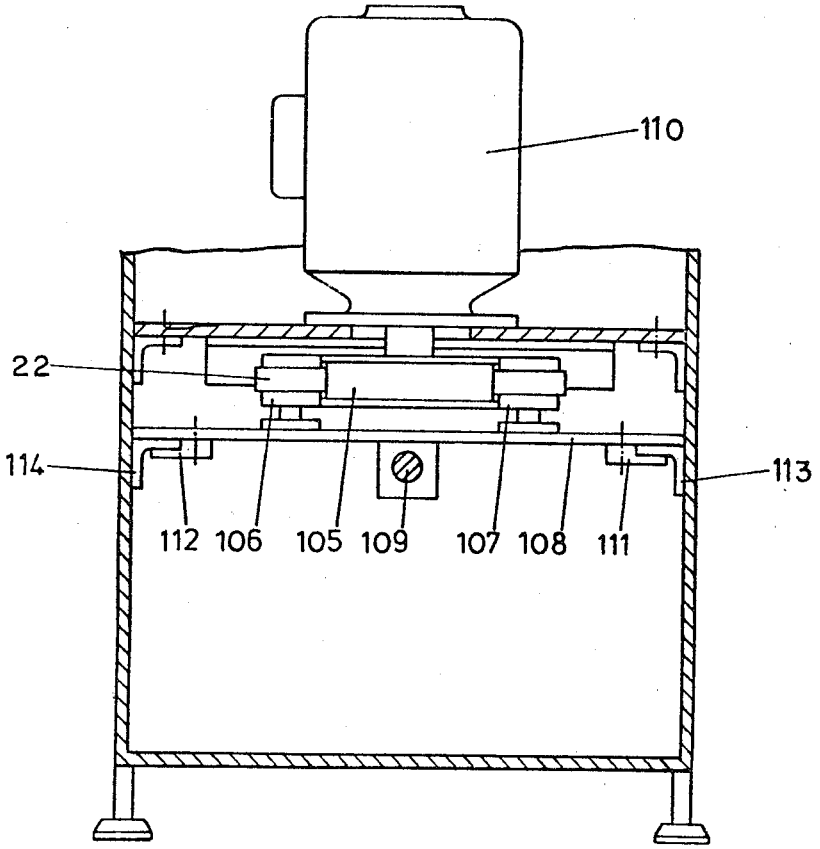
FIG. 8 is a vertical sectional view taken along line 8—8 of FIG. 7.

The aforementioned belt drive assembly when utilized in the vertical spindle machine is driven by the mechanism illustrated in FIGS. 7 and 8. As the belt 22 contacts the whorl portions 7 of the spindle assemblies 6 tangentially, it must be maintained taut to impart positive frictional drive without slipping. Due to the natural elasticity of belt material and the long length of the reach of the belt throughout the entire machine, means must be included to adjustably tension the belt during operation. As seen in FIG. 7, the belt travels along one reach past the whorl portions 7 of the spindle assemblies 6 in one row and around an idler roll 104 in the aforementioned end housing 83 at one end of the machine. The belt 22 then passes through its other reach in driving contact with the whorl portions 7 of the spindle assemblies 6 in the other row to the drive housing 82 at the other end of the machine. In the drive housing 82 the belt passes around guide rolls 103 that deflect the reach of the belt laterally outward and from which the belt passes around a movable roll 106 back to a stationary drive roll 105 and then around another movable roll 107. The movable rolls 106 and 107 are located longitudinally beyond the stationary drive roll 105 to impose belt contact on the drive roll over substantially half the surface thereof and thereby obtaining positive driving of the belt by the drive roll 105 which is driven by a conventional drive motor 110 (FIG. 8) in the drive housing 82. To tension the belt 22 and maintain tautness sufficient for positive driving of the whorl portions 7, the movable rolls 106 and 107 are mounted on a horizontally disposed slide 108 mounted for longitudinal sliding on horizontal guide rails 113 and 114 in the drive housing 82, with the slide 108 being maintained on the guide rails 113 and 114 by angle brackets 111 and 112, respectively. The slide 108 is adjustable to take up slack in the belt 22 by a threaded rod 109 extending through the end of the drive housing 82 into threadable engagement with the slide 108, whereby rotation of the threaded rod 109 will cause the slide 108 to advance to the end of the drive housing 82 to increase tension on the belt 22 or to advance away from the housing end to relieve tension on the belt.

Figure 9:
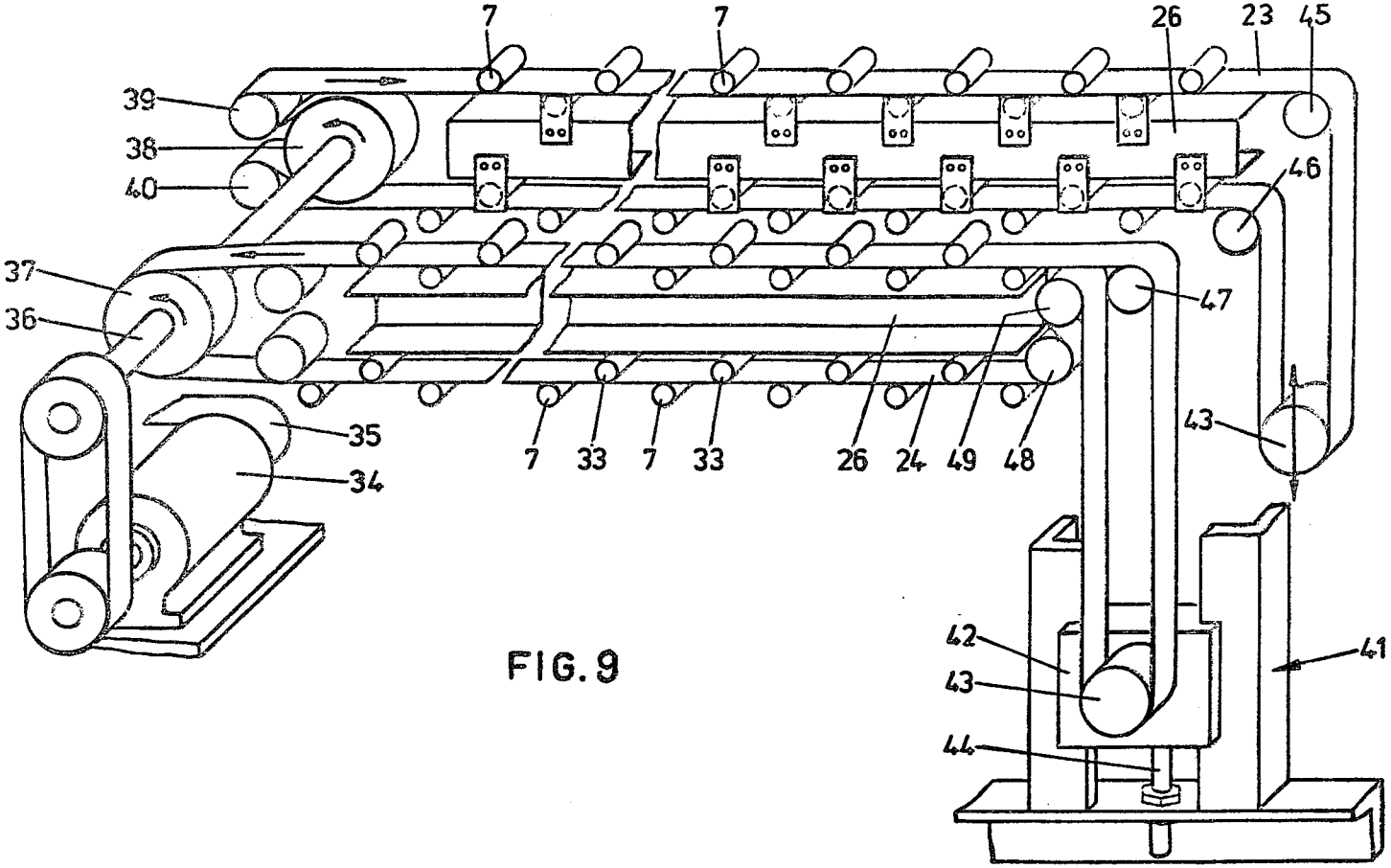
FIG. 9 is a perspective view, partially broken away, illustrating the belt drive assembly of the horizontal spindle machine of FIG. 2.

In the horizontal spindle machine separate drive means may be provided for each belt 23, 24, but preferably for cost and space economies, a single drive motor 34 is utilized to drive both of the belts as well as the traversing rods 16. The preferred belt drive assembly for the horizontal spindle machine is illustrated in FIG. 9, which shows the previously described support and guidance of the drive belts in tangential driving contact with the whorl portions 7 of two rows of spindle assemblies 6 on each side of the machine. The drive belts are supported and guided in tangential driving contact with the whorl portions 7 and the drive means drives the belts in opposite directions so that the winding operation will be in the same rotational direction when facing either side of the machine. To accomplish this operation, the drive motor 34 drives the traversing rod drive belt 35 for purposes explained herein below and also rotates a drive shaft 36 on which a pair of belt drive rolls 37 and 38 are mounted in alignment with the belts 23 and 24 for training of the belts therearound. As illustrated in FIG. 9, the belt 24 in front in this figure passes directly around the drive roll 37 in a counterclockwise direction for movement of the upper reach of the belt to the left and the lower reach of the belt to the right, thereby imparting a clockwise rotation to the whorl portions 7 of the spindle assemblies. So that the whorl portions 7 of the spindle assemblies 6 on the back side of the machine in FIG. 9 will also rotate in a clockwise direction when facing the back side of the machine, the upper reach of the back belt 23 is caused to move to the right and the lower reach to the left, which is the opposite of the direction of movement of the front belt 24. To accomplish this with counterclockwise rotation of the drive roll 38, a pair of reversing rolls 39, 40 are disposed beyond the back drive roll 38 with one of the reversing rolls 39 extending above the level of the drive roll 38 and the other reversing roll 40 extending below the level of the drive roll 38. In this manner the back belt 23 is trained around the lower reversing roll 40 back around the drive roll 38 and then around the upper reversing roll 39, resulting in a direction of travel opposite to that of the front belt 24 that is trained directly around its drive roll 37. However, this results in a longer belt path for the back belt 23 than for the front belt 24. To compensate for this so that a single length belt can be stocked for use as either drive belt, a compensating roll 49 is mounted at the opposite end of the machine at an upward offset from the lower reach of the front belt 24 for training of the belt at the end of the lower reach around a deflection roll 48 to the compensating roll 49 and then down to a tensioning device, with the amount of offset of the compensating roll 49 being equivalent to the cumulative offset resulting from the use of the reversing roll 39, 40 for the rear belt 23, thereby increasing the travel length substantially equivalent to the increase in the travel length resulting from the reversing rolls.

To maintain proper tension of the belts 23 and 24 for tangential driving contact of the whorl portions 7, belt tensioning means are disposed beyond and offset from the end of the reaches of the belts opposite the drive rolls 37 and 38 for tensioning and deflecting the belts at an inclination from the horizontal extent of the belt reaches. There is such a belt tensioning means associated with each of the belts, but for simplicity of illustration only the belt tensioning means associated with the front belt 24 is illustrated in FIG. 9. This belt tensioning means includes a slide member 42 movable at the inclination of deflection, which is vertical in FIG. 9, and which slide member 42 has mounted thereon a tensioning roll 43 for movement therewith and around which the drive belt 24 is trained at its outer extent. The slide member 42 slides in a slideway 41 and a threaded rod 44 connects the slide member 42 and slideway 41 for adjusting the position of the slide member 42 with respect to the slideway 41 by threaded adjustment of the threaded rod 44 in the slideway 41. Guide rolls 45 and 46 are provided for training the rear belt 23 from its horizontal reaches to the tensioning roll 43, and a guide roll 47 is provided for training the front belt 24 from its upper reach down to the tension roll 43 while the compensating roll 49 serves the same purpose, in addition to increasing the belt length, for the front belt at the end of its lower reach.

Figure 10:
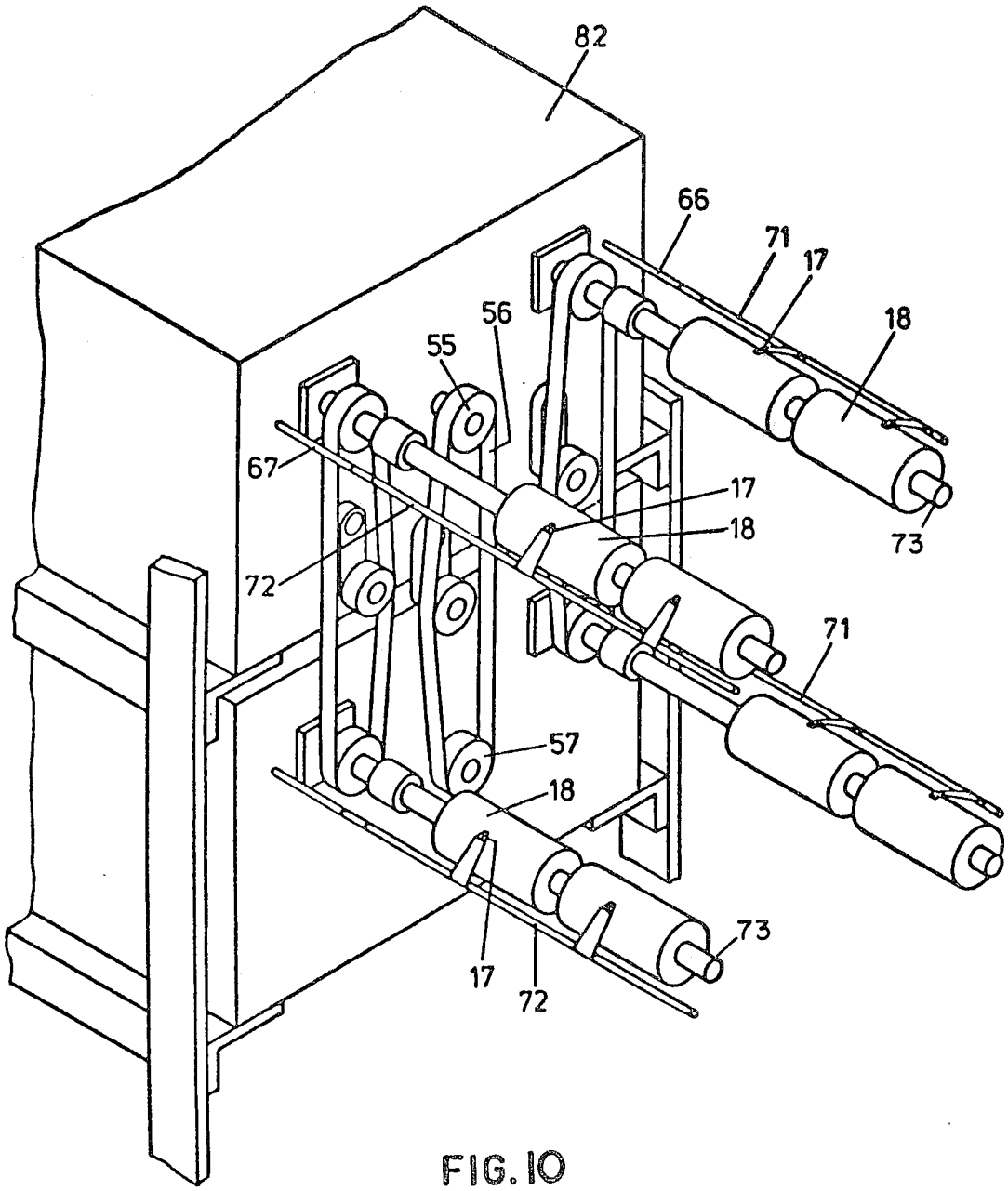
FIG. 10 is a partially broken-away perspective view of the drive housing and traversing rod driving means of the horizontal spindle machine of FIG. 2.
Figure 11:
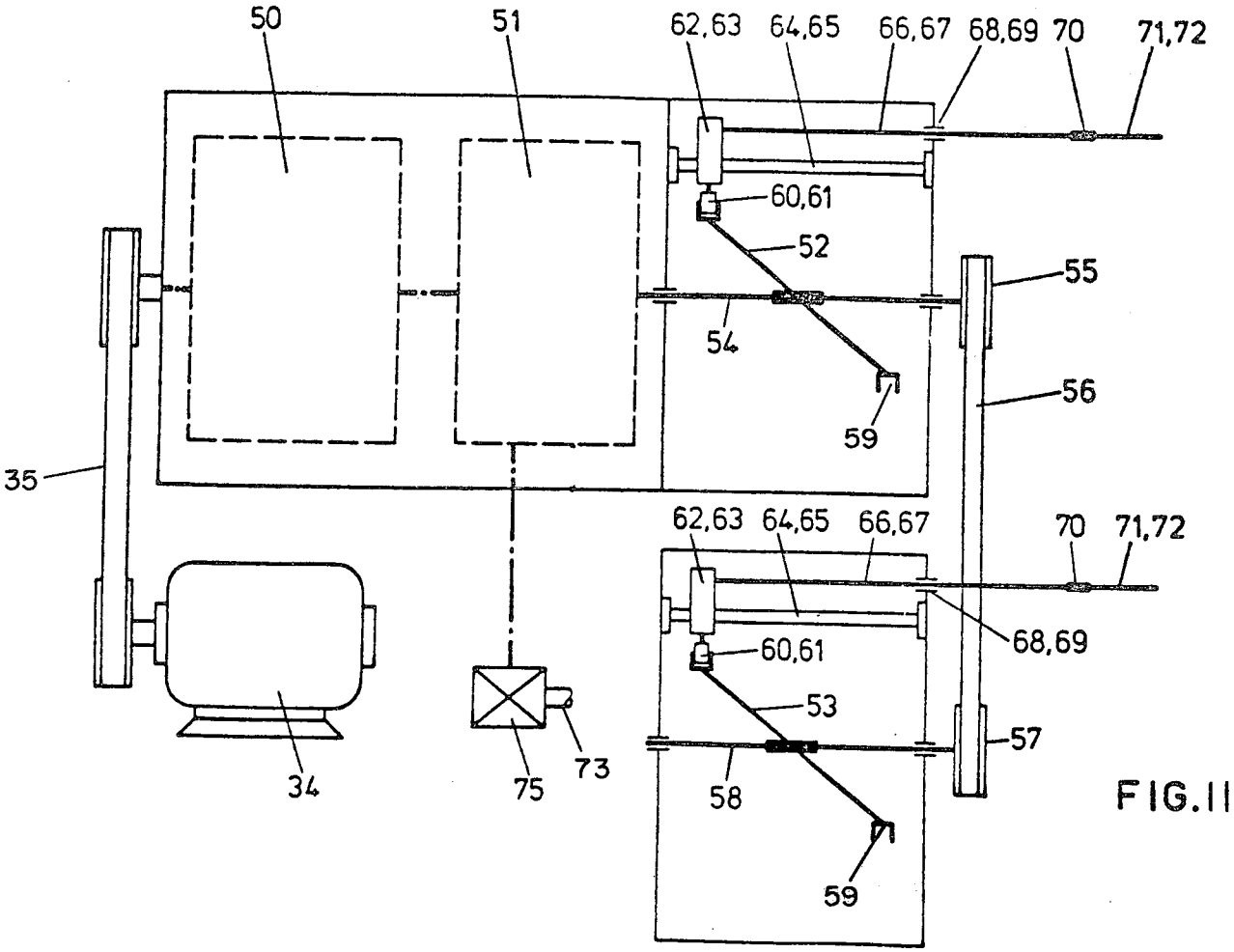
FIG. 11 is a diagrammatic illustration of the means for reciprocating the traversing rods of the horizontal spindle machine of FIG. 2.
Figure 12:
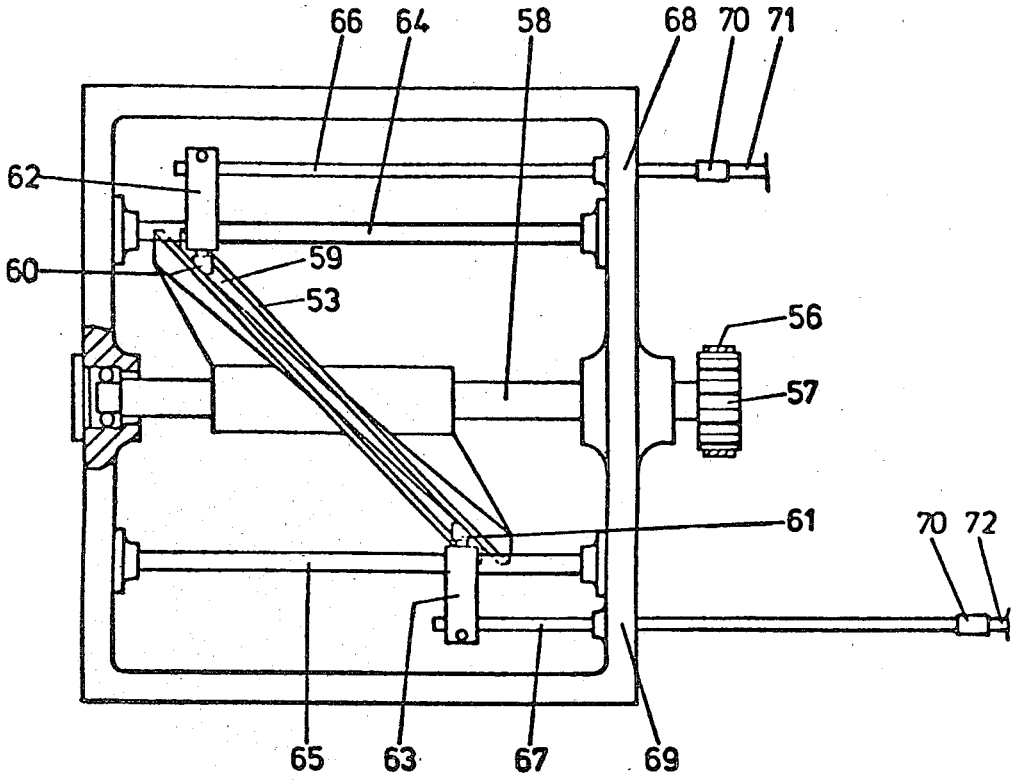
FIG. 12 is a plan view of the cam drive mechanism of the means for reciprocating the traversing rods illustrated in FIGS. 10 and 11.

The aforementioned traversing rods 16 are driven by the same drive motor 34 as the belt drive assembly through means for reciprocating the traversing rods that includes conventional means for reciprocating the two upper rods while incorporating a unique connection for operating the two lower traversing rods rather than utilizing a separate drive means. This means for reciprocating the traversing rods is illustrated in FIGS. 10, 11 and 12, which shows the aforementioned drive motor 34 driving the traversing rod drive belt 35, which in turn drives a conventional replaceable gear assembly that produces a desirable output in relation to the input from the drive motor 34 and can be replaced by gear assemblies of different ratios for producing different operating speeds. The replaceable gear assembly 50 in turn drives a traverse modulating gear assembly 51 of conventional design that imposes a modulated traversing pattern to the take-up winding of the yarn through a drive connection 75 for driving the shafts 73 on which the take-up drive rolls 18 are mounted. The output of the traverse modulating gear assembly 51 is also imposed on a cam drive shaft 54 on which a cam disc 52 is mounted for rotation. The cam disc 52 is formed with a peripheral groove 59 in which spaced cam followers 60 and 61 are disposed for movement thereby to cause reciprocation of connected slide members 62 and 63 on horizontal guide bars 64 and 65. The slide members 62 and 63 are connected to coupling rods 66 and 67 for reciprocation thereof through bearings 68 and 69 in the drive housing 82. The coupling rods 66 and 67 are aligned with the upper traversing rods 71 and 72 for reciprocal driving connection thereto through couplings 70. As described to this point, the means for reciprocating the traversing rods is of conventional construction.

However, rather than using another conventional driving mechanism to reciprocate the lower traversing rods, drive is taken directly and synchronously from the cam shaft 54 on which a pulley 55 is mounted for driving a belt 56 that rotates a pulley 57 mounted on the end of another cam drive shaft 58 on which a second cam disc 53 is mounted. This second cam disc 53 is identical to the first cam disc 52 and through similar operating connections drives the lower traversing rods 71 and 72 (which are designated 16 in FIGS. 1 and 2). Thus, a drive take-off means is provided for driving the second cam and cam follower from the first cam without an additional drive motor or gear assemblies. FIG. 11 is a schematic illustration of the described construction and FIG. 12 is a view of the second cam disc 53 and connecting components, which are identical to the first cam disc 52 and connecting components. It should be noted that FIG. 12 is a horizontal view of the cam disc arrangement showing the cam followers at a horizontal spacing, whereas FIG. 11 is simply a schematic illustration in which the spacings of the cam followers is not apparent.

This means for reciprocating the traversing rods can also be used in a vertical spindle machine of the type having two levels of spindle assembly rows wherein there are two vertically spaced spindle frames.

It should be noted that the details of the spindle frame, separator wall and spindle assembly features are illustrated and described herein in detail for completeness of disclosure only and form no part of the present invention other than to demonstrate machine components to which the present invention is applicable. These spindle frame, separator wall and spindle assembly features are disclosed and claimed in a concurrently filed application owned by the common assignee, the inventors of which are identified as Schipprs, Hartig, Rehn, Weber, Middelmann, Schulte, and Wessolowski.

Further it should be understood that the detailed illustration and description contained herein is provided for purposes of disclosure only and that the scope of the present invention is not intended to be limited solely thereto as the scope of the invention is intended to be defined by the appended claims and equivalents and variations thereof.

We claim:

1. In a multi-spindle double twist twisting machine of the type in which spindle assemblies are mounted with whorls aligned in at least one longitudinal row, a belt drive assembly for driving said whorls comprising a drive belt extending longitudinally adjacent said whorl row, belt supporting and guiding elements for guiding said belt in contact with said whorls, means for supporting said belt guiding elements, said support means being mounted in said machine independent of the mounting of said spindle assemblies, and means for driving said belt.

2. A belt drive assembly according to claim 1 and characterized further in that said support means comprises a beam extending longitudinally through a section of said machine adjacent said row of whorls, said beam supporting said belt guiding elements for belt guiding projection therefrom adjacent said whorls.

3. A belt drive assembly according to claim 2 and characterized further in that there are two longitudinally extending rows of whorls, said beam extends longitudinally between said rows, and said belt guiding elements project from said beam adjacent both rows of whorls for supporting and guiding said belt to position one reach of said belt in contact with the whorls in one row and another reach of said belt in contact with the whorls in the other row.

4. A belt drive assembly according to claim 3 and characterized further in that said belt guiding elements and both reaches of said drive belt are disposed between said whorl rows.

5. A belt drive assembly according to any of claims 1, 2, 3 or 4 in which said supporting and guiding elements support and guide said belt in substantially tangential driving contact with said whorls to permit disengagement of one or more whorls without slackening of said belt sufficient to disrupt drive of the other whorls.

6. A belt drive assembly according to claim 1 and characterized further in that said machine is formed in a longitudinally extending plurality of sections with frame stands at each end of each section, and said support means comprises a plurality of beams, each beam extending longitudinally through a machine section adjacent a row of whorls and supporting said belt guiding elements for belt guiding projection therefrom adjacent said whorls, each said beam having its ends mounted to said frame stands independent of the mounting of said spindle assemblies.

7. In a multi-spindle double twist twisting machine of the type in which spindle assemblies are mounted with whorls aligned in at least one longitudinal row, a spindle frame for supporting spindle assemblies and a belt drive assembly for driving said whorls, said spindle frame comprising at least one longitudinally extending support plate for mounting spindle assemblies thereon with whorl portions projecting in freestanding arrangement from one side of said plate, said support plate having side flanges projecting from the longitudinal edges thereof in the direction of projection of said whorl portions to provide sides to said spindle frame for attachment of enclosure plates thereto, said belt drive assembly comprising at least one drive belt extending longitudinally adjacent said whorl row and between said flanges, belt supporting and guiding elements for guiding said belt in contact with said whorls, means for supporting said belt guiding elements, and means for driving said belt.

8. A spindle frame and a belt drive assembly according to claim 7 and characterized further by longitudinally extending enclosure plates secured to said flanges and forming with said support plate an enclosure enclosing the extent of said belt drive assembly adjacent said whorl row.

9. A spindle frame and a belt drive assembly according to claim 8 and characterized further by a liner of noise dampening material on the interior of said enclosure.

10. A spindle frame and a belt drive assembly according to claim 7 and characterized further in that said at least one longitudinally extending support plate comprises a pair of spaced and opposed support plates vertically disposed for supporting spindle assemblies with their axes horizontal and their whorl portions projecting in horizontal rows in freestanding arrangement in the space between support plates, and longitudinally extending enclosure plates extending between said support plates and secured to the flanges thereof to form with said support plates an enclosure enclosing the extent of said belt drive assembly adjacent said whorl rows.

11. A spindle frame and belt drive assembly according to claim 10 and characterized further in that each support plate supports two vertically spaced horizontally extending whorl rows, said means for supporting said belt guiding elements comprises two longitudinally extending beams, one disposed between the whorl rows of one of said support plates and the other disposed between the whorl rows of the other of said support plates, said belt supporting and guiding elements being supported on said beams, and said at least one drive belt comprising a pair of drive belts, one supported and guided by said elements on one of said beams between the whorl rows on one support plate, and the other drive belt supported and guided by said elements on the other of said beams between the whorl rows on the other support plate.

12. A spindle frame and belt drive assembly according to claim 11 and characterized further in that said beams are mounted in said machine independent of the mounting of said spindle frame.

13. In a multi-spindle double twist twisting machine of the type in which spindle assemblies are mounted in two vertically spaced longitudinally extending horizontal rows on each side of said machine, the spindle assemblies having their axes horizontal and whorls projecting laterally inward in two vertically spaced rows or whorls in each side of the machine, a belt drive assembly comprising two drive belts, one on each side of the machine extending adjacent both whorl rows on that side, means for supporting and guiding said drive belts in tangential driving contact with the whorls in both rows on each side of the machine, and means for driving said belts.

14. A belt drive assembly according to claim 13 and characterized further in that said belt driving means drives said belts in opposite directions.

15. A belt drive assembly according to claim 13 and characterized further in that said drive belts have upper reaches in tangential driving contact with the whorls in the upper row of whorls and a lower reach in tangential driving contact with the whorls in the lower row of whorls.

16. A belt drive assembly according to claim 15 and characterized further in that said belt driving means comprises a drive motor, a common drive shaft driven by said drive motor and extending between the reaches of said drive belts at one end thereof, a drive roll mounted on said shaft at each drive belt and around which said belts are trained for driving thereby, and a pair of reversing rolls disposed beyond one of said drive rolls with one of said reversing rolls extending above said one drive roll and the other extending below said one drive roll for training of said drive belt at that side of the machine from one of said belt reaches around one of said reversing rolls, back reversely around said one drive roll and around the other reversing roll to the other of said belt reaches, thereby driving said one drive belt in a direction opposite the direction the other of said drive rolls drives the other of said drive belts.

17. A belt drive assembly according to claim 16 and characterized further by a compensating roll mounted for training of said other drive belt therearound, said compensating roll being offset with respect to the path of said other belt to increase the travel length of said other belt substantially equivalent to the increase in travel length of said one drive belt resulting from said reversing rolls.

18. A belt drive assembly according to claim 17 and characterized further in that said compensating roll is adjacent the end of the belt reaches opposite the location of said drive rolls.

19. A belt drive assembly according to claim 15 and characterized further in that said belt driving means drivingly engages said belts at one end of said reaches and by belt tensioning means disposed beyond and offset from the other end of said reaches for tensioning and deflection of said belts at an inclination from the horizontal extent of said reaches.

20. A belt drive assembly according to claim 19 and characterized further in that said belt tensioning means includes a slide member movable at said inclination and a tensioning roll mounted on said slide member for movement therewith and around which said drive belt is trained for tensioning thereof.

21. A belt drive assembly according to claim 20 and characterized further in that said belt tensioning means includes a threaded rod attached to said machine and threadably engaging said slide member for adjustable movement of said slide member to adjust the tension of said drive belt.

22. A belt drive assembly according to claim 13 and characterized further in that said means for supporting and guiding said drive belts comprises two longitudinally extending beams, one adjacent the whorl rows on one side of the machine and the other adjacent the whorl rows on the other side of the machine, and belt supporting and guiding elements supported on said beams and supporting and guiding said belts in tangential driving contact therewith.

23. A belt drive assembly according to claim 22 and characterized further in that said beams extend longitudinally between the whorl rows and said belts have upper reaches below and in contact with the whorls in the upper whorl row and lower reaches above and in contact with the whorls in the lower whorl row.

* * * * *